United States Patent [19]

Haller et al.

[11] 4,012,624

[45] Mar. 15, 1977

[54] ELECTRIC PULSE COUNTER AND PLASTIC HOUSING THEREFOR

[75] Inventors: Andreas Haller; Heiner Kundisch, both of VS-Schwenningen, Germany

[73] Assignee: Irion & Vosseler, Germany

[22] Filed: Apr. 14, 1976

[21] Appl. No.: 676,647

[30] Foreign Application Priority Data

May 14, 1975 Germany ..... 2521372

[52] U.S. Cl. ..... 235/92 C; 235/92 R

[51] Int. Cl.[2] ..... G06M 1/02

[58] Field of Search ..... 235/92 C, 91 M, 1 C; 335/140

[56] References Cited

UNITED STATES PATENTS

| | | | |
|---|---|---|---|
| 3,341,694 | 9/1967 | Heimberger et al. | 235/92 C |
| 3,665,166 | 5/1972 | Miyagawa et al. | 235/92 C |
| 3,916,164 | 10/1975 | Kundisch et al. | 235/92 C |

*Primary Examiner*—Joseph M. Thesz
*Attorney, Agent, or Firm*—McGlew and Tuttle

[57] ABSTRACT

An electromagnetic pulse counting mechanism comprises a rectangular block shaped housing having first and second housing parts which are interengageable and with one part defining a side wall and a rear wall and the other part defining all of the other walls. The other part includes an intermediate partition wall between the top and bottom walls, which has a coil receiving tube extending rearwardly thereof. An electromagnetic coil is positioned over the receiving tube and a U-shaped magnetic yoke has one leg portion inserted into the tube and another arranged alongside the coil in the housing. The opposed side walls of the housing define journals for receiving shafts of a cypher roll or rolls and an indexing mechanism for indexing the cypher roll or rolls. An armature is supported in this end of the housing directly adjacent the coil and one leg of the yoke and it is moved by actuation of the coil to move the indexing mechanism to advance the cypher roll. The front wall of the one part of the housing includes a window opening for viewing the cyphers on the rolls which are exposed in the window.

6 Claims, 4 Drawing Figures

ELECTRIC PULSE COUNTER AND PLASTIC HOUSING THEREFOR

FIELD AND BACKGROUND OF THE INVENTION

This invention relates in general to the construction of counters and in particular to a new and useful inexpensive counter composed of two interfitting housing parts having instructions for facilitating the positioning of an electromagnet and a coil and an armature for actuation of an indexing mechanism for moving cypher rolls.

DESCRIPTION OF THE PRIOR ART

Many types of counter devices are known and in many constructional embodiments. They are introduced in great numbers both with zeroizable and nonzeroizable cypher rolls, and they are frequently used for recording various counting units. In order to keep the labor cost of the assembly of such devices very low and to reduce the manufacturing cost of the parts to a minimum, it is common to make not only the mechanically moving parts of the mechanism but also the frame and the housing of plastic material. In one type of counter there is a plastic housing which is opened at the top and hence it is designed without a molded-on cover. The housing extends only to the flange of the coil form facing the front wall. The coil form is designed as a separate part and must be inserted into the housing so that its front flange forms the rear wall of the housing. The magnetic yoke consists of an angular plate which must be screwed on the housing bottom at its front end. Magnetic yoke and coil core comprise two different parts which must be joined with each other by means of screws. Special protective caps are required for covering the coils and the tops of the housing. The side wall of the housing is provided with bearing axles and is designed as a separate part and must be secured on the housing after the cypher rolls and the transmission pinions are assembled.

In a similar known operating counter the bearing axles of the cypher rolls and of the indexing mechanisms are designed as separate parts which can be inserted from the top into the bearings which are designed as circular openings in holders, the openings being laterally open due to an oblong slot whose width is smaller than the diameter of the axles or shafts. The housing is composed of two housing parts. One housing part comprises the two side walls, the rear wall, the cover and the front wall which is provided with a sight window. The other housing part consists merely of the bottom plate on which the housing top is attached in the manner of a hood.

Still another known counter as described in U.S. Pat. No. 3,580,498 includes a frame made of plastic which has the shape of a coil form whose flanges are so shaped that they are used both as bearing plate bars for the counter mechanism and to receive the iron yoke as well as the shift fork which is also made of iron. Both the cypher rolls and the indexing mechanism are mounted on metal shafts, which are mounted in corresponding bores of the side of the walls of the frame. This known plastic frame is open on all sides and requires additionally a housing into which the finish-mounted counter can be inserted for protection. Such an additional housing is also required in the other known types of counter mechanisms where the counter housing has in the front part an open top for inserting the counter mechanism, and where the electromagnet, for which a specially shaped coil form is provided, can be inserted from the rear into the housing and be locked there. In a counter which has a zeroizable roll counter and which has a plastic frame, practical use is possible only with an additional housing, since the frame is also open at the top and the counter mechanism would be freely accessible without this additional housing.

SUMMARY OF THE INVENTION

The present invention provides an electromagnetic pulse counter in which the housing is made of only two parts which are held together by interlocking connections and only an air coil is provided for the electromagnet, so that no special coil form is required. The magnetic yoke is mounted in the housing without special tools and no separate axles are required for the bearings of all parts belonging to the counter mechanism. No separate side walls or other separate devices are necessary so that the assembly of these parts can be effected in a very simple manner.

The design of the invention so that there are two housing parts which interfit ensures not only that the resultant structure is simple in design and inexpensive to make and to assemble, but also the parts may be formed of injection molded parts, since the tool separating planes coincide with the longest sides of the housing parts, and therefore cost savings can be achieved with such a construction. The housing can be assembled practically without any auxiliary tools. By making one housing part with a partition wall having a coil receiving tube which extends rearwardly of the partition, it is possible easily to locate both the magnetic coil and the legs of the yoke without requiring any additional support elements. The assembly of both the coil and the yoke may be effected by pushing the coil over the tube and positioning one leg of the yoke into the tube.

The bearing axles for supporting the cypher roll and the indexing mechanism may be made of unequal length and the walls may be provided with blind bores which form journals for rotatably supporting these axles. They may be arranged easily in different planes merely by arranging blind bearing holes at the desired location in the respective side walls. Such a construction greatly simplifies the assembly of the various parts.

Accordingly it is an object of the invention to provide an electromagnetic pulse counting mechanism which includes two housing parts which are interengagable and with one part having a partitioned wall having a receiving tube extending rearwardly of the partition over which a coil is placed and into which one leg of a magnetic yoke is positioned and which also includes side walls having journals in the form of recesses or blind bores for supporting shafts of a cypher roll and the associated indexing mechanism, and which also includes a bottom forming a pivotal support for an armature which operates the indexing mechanism under the control of the coil.

A further object of the invention is to provide an electromagnetic pulse counting mechanism which is simple in design, rugged in construction and economical to manufacture.

For an understanding of the invention, reference is made to the following description of the embodiment thereof as illustrated in the accompanying drawings.

GENERAL DESCRIPTION OF THE PREFERRED EMBODIMENTS

Figure 1:
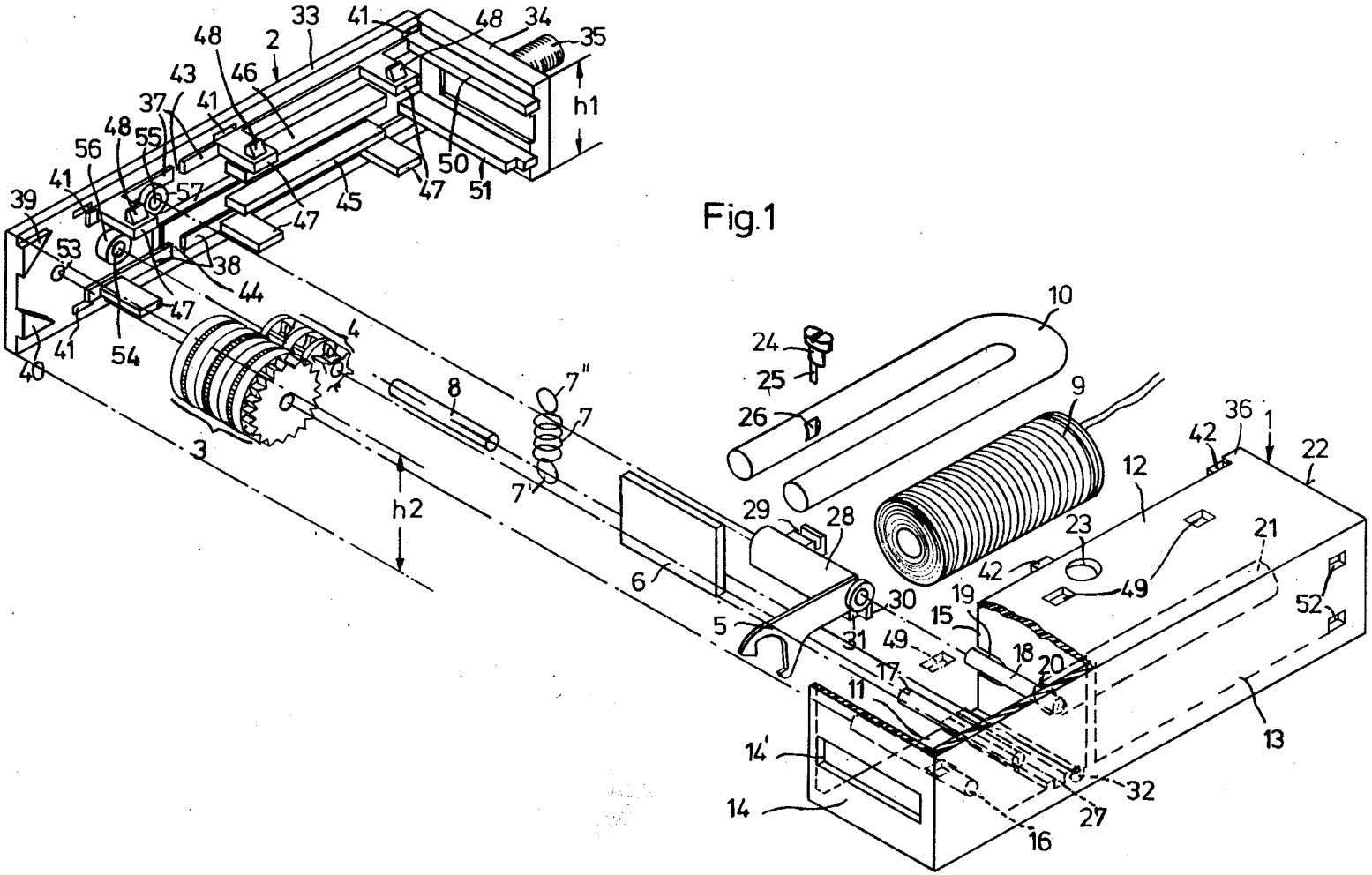
FIG. 1 is an exploded perspective view of an electromagnetic pulse counter constructed in accordance with the invention.
Figure 2:
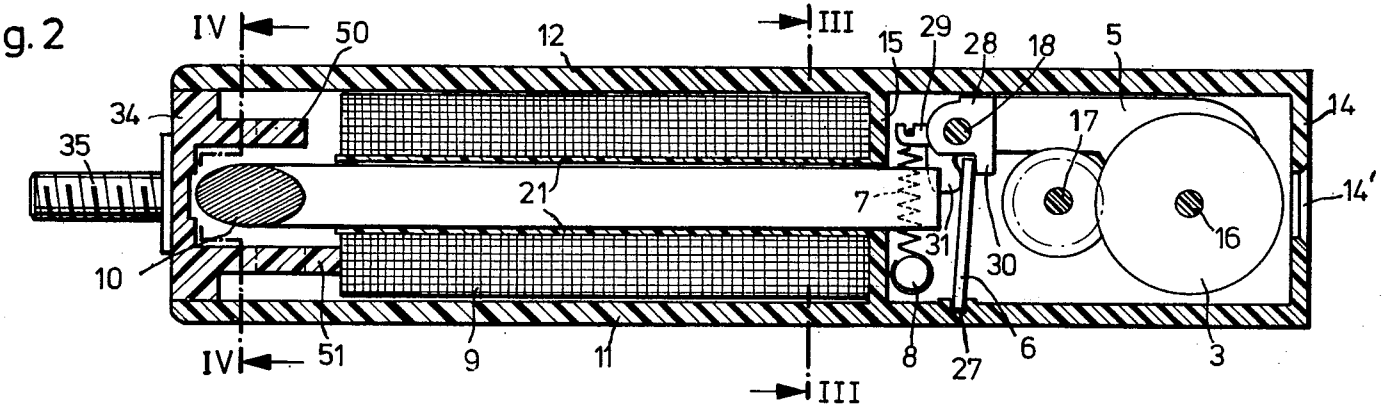
FIG. 2 is a longitudinal sectional view of the assembled counter shown in FIG. 1.

Referring to the drawings in particular, the invention embodied therein comprises, as seen in FIG. 2, an electric pulse counter which includes a housing made up of two housing parts 1 and 2. The first plastic housing part 1 forms a square hollow body which has a housing bottom 11, housing cover or top wall 12, side wall 13, housing front wall 14 provided with a window opening 14′ and an intermediate partition wall 15 extending between the top and bottom walls. In the cavity of plastic housing part 1 provided between partition 15 and front housing wall 14 are arranged bearing axles 16, 17 and 18 serving to support the cypher roll set 3, the set of indexing mechanisms 4 and shift fork 5 respectively. Partition 15 has two openings 19 and 20 to receive the free ends of magnet yoke 10, opening 19 being U-shaped and open at the free end face of partition 15, while opening 20 has the cylindrical cross sectional form of magnet yoke 10. Concentrically to opening 20 is arranged a cylindrical coil receiving tube 21 which is integral with partition 15 and which extends parallel to side wall 13, housing bottom 11 and housing cover 12 respectively, both on the side opposite wall 13 and on the open rear part of plastic housing part 1 opposite the front end wall. This coil receiving tube 21 terminates in a certain axis distance from the rear end plane 22 of plastic housing part 1 and serves to receive magnet coil 9, as well as one leg of magnetic yoke 10. An eccentric journal 24 for the axial fastening and adjustment magnet yoke 10 is mounted in a bore 23 of housing cover 12 and it has an eccentric pin 25 which engages a notch 26 of the free magnet yoke arm.

For the pivotal support of the armature 6 designated as a rectangular plate, housing bottom 11 is provided with a groove 27 in the range under bearing axle 18. A shift fork 5 for shifting cypher roll or rolls 3 consists of a molded plastic part integral with a bearing tube 28 and which has a spring hook 29 to engage tension spring 7. On its underside the fork 5 has two cams 30 and 31 engaging armature 6 on both sides. Notched pin 8 is pressed into blind bore 32 of side wall 13, on which is suspended bottom lug 7′ of tension spring 7. The upper lug 7″ of spring 7 is suspended on spring hook 29 of shift fork 5.

The preliminary assembly of the parts 3 to 10 is effected as follows: After notched pin 8 has been pressed into blind bore 32, shift fork 5 is first placed on bearing axle 18, then cypher roll 3 and indexing mechanisms 4 are applied on bearing axles 16 and 17, and finally spring 7 is engaged and armature 6 is inserted into groove 27. The insertion of one arm of the magnet yoke into coil receiving tube 21 is effected after coil 9 has been pushed over the tube. After the magnet yoke 10 is secured axially by means of eccentric journal 24, a functional test of the counter mechanism can already be made. For the final assembly of the counter it is then only necessary to join plastic housing part 2 with plastic housing part 1.

Plastic housing part 2 consists of a second side wall 33 to close this side of the housing part 1, and of the rear end wall 34 to close the rear of plastic housing part 1. A threaded pin 35 is integrated with the rear wall 34 on the outside. While the height of rear wall 34 is so dimensioned that it fits between housing bottom 11 and housing cover 12, the height h2 of side wall 33 corresponds to the distance between the outer surface of housing bottom 11 and housing cover 12. These recesses are formed at the upper and lower corners between rear end wall 34 and side wall 33 corresponding to the thickness of housing bottom 11 and housing cover 12, which are filled by corresponding projections 36 of housing bottom 11 and housing cover 12, when the two housing plastic parts 1 and 2 are assembled. In order to ensure a good stability of shape of the entire housing, longitudinal ribs 37 and 38, as well as triangular projections 39 and 40 are arranged on the inner side of side wall 33 in the distance of the inner surfaces of housing bottom 11 and housing cover 12. The ribs absorb the inwardly directed forces acting on housing bottom 11 and housing cover 12. In order to avoid bending of housing bottom 1 and housing cover 12, housing wall 33 is provided along ribs 37 and 38 in equal intervals with recesses 41 which serve to receive fitting projections 42 provided on the open longitudinal edges of housing bottom 11 and housing cover 12. To make sure that partition 15 of plastic housing part 1 can bear throughout on the inner surface of side wall 33, the ribs 37 and 38 are interrupted at corresponding points 43 and 44 respectively. Between the ribs 37 and 38 are arranged longitudinally extending strips 45 and 46 whose distance corresponds to the thickness of magnet yoke 10 and which receive and hold between them the free arm yoke 10.

On the ribs 37 and 38 are molded parallel to housing bottom 11′ and to housing cover 12′ inwardly directed locking tongues 47 with sawtooth notches 48 which are received in openings 49 provided in housing bottom 11 and housing cover 12 of plastic housing part 1.

The rear end wall 34 is also provided on its inner side with ribs 50 and 51. While rib 50 serves mainly to increase the stability of shape, rib 51, which is somewhat wider, has the additional function of fixing coil 9 in an axial direction on coil receiving tube 21. In order to obtain a frictional connection between side wall 13 of plastic housing part 1 and rear end wall 34, the ribs 50 and 51 are extended by the thickness of side wall 13 beyond the width of end wall 34 and are provided with openings 52 to receive the extensions in side wall 13.

With such a design of the two plastic housing parts 1 and 2 it is possible to obtain a non-deformable, simple-to-assemble counter housing for a counter consisting of a minimum of different parts, which is at the same time a protective frame and a bearing support for the individual counter parts.

In order to make the bearing axles 16, 17 and 18 completely swing-free for a proper operation of the counter, blind bores 53, 54 and 55 are provided in side wall 35 of the second plastic housing part 2, into which the ends of the bearing axles 16, 17 and 18 extend, after the two housing parts have been assembled. It is of advantage if the blind bores 53, 54 and 55 are arranged in different planes and the bearing axles 16, 17 and 18 are of different length, because this facilitates the assembly of the two plastic housing parts 1 and 2 and the threading of the bearing axle ends into the blind bores 53, 54 and 55. In addition the effect of axial rings, which would otherwise be necessary, can be accomplished by ring lugs 56 and 57, which are cylindrical in the present embodiment, and which are molded on the inside of the side wall 33, at least for the two blind bores 54, 55.

The above described plastic housing parts 1 and 2 are advantageously designed in their constructional form with regard to the form and size of the required injection molds, so that a cost-saving effect is achieved in this respect too.

Figure 4:
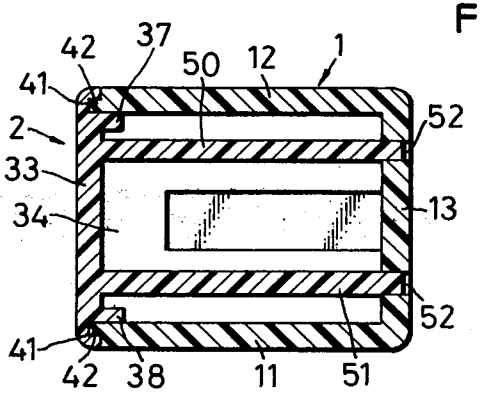
FIG. 4 is a section taken along the line IV-4 of FIG. 2.
Figure 3:
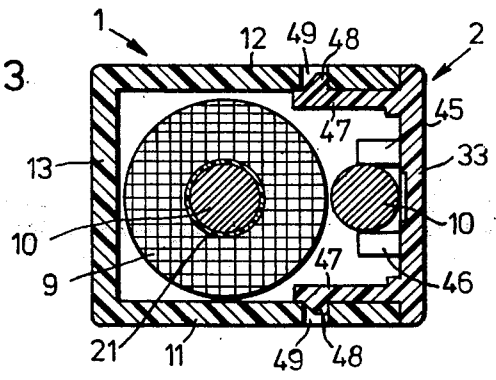
FIG. 3 is a section taken along the line III-3 of FIG. 2.

Instead of notched pin 8 and tension spring 7, fork shift 5 could also be provided with an integrally molded, form elastic spring-tongue which can bear on partition 15, if necessary, so that tension spring 7 and notched pin 8 can be eliminated. FIGS. 2, 3 and 4 show how the two plastic housing parts 1 and 2 are frictionally connected with each other. FIG. 3 shows how the two strips 45 and 46 guide one arm of the U-shaped magnet yoke 10 between them, and FIG. 4 shows how the extended ribs 50 and 51 engaged the opening 52 and the projections 42 the recesses 41.

While specific embodiments of the invention have been shown and described in detail to illustrate the application of the principles of the invention, it will be understood that the invention may be embodied otherwise without departing from such principles.

What is claimed is:

1. An electromagnetic pulse counting mechanism, comprising a rectangular block shaped housing having a first housing part with a top wall, bottom wall, front wall, and a first side wall, and having an intermediate partition wall spaced from said front wall and extending between said top and bottom walls, a second housing part comprising a second side wall and rear wall, said second housing part being interengageable with said first housing part to enclose the rear and side opposite to said first side wall of said first housing part of said housing; a coil receiving tube extending rearwardly from said partition wall toward said rear wall in said housing; an electromagnetic wound coil positioned over said receiving tube in axis alignment therewith; a U-shaped magnetic yoke having one first leg portion in said receiving tube and within said coil, and a second leg portion disposed in said housing alongside said coil; an armature pivotally supported on said bottom adjacent said coil, and said yoke; a cypher roll having a cypher roll shaft; an indexing mechanism for indexing said cypher roll having an indexing shaft, and journal means defined on said first and second side walls on the opposite side of said partition wall from said coil, for supporting said cypher roll shaft and said indexing mechanism shaft adjacent said armature for actuation of said indexing mechanism by said armature when said coil is excited; and a window defined in said front wall for the visual observation of aligned cyphers on said cypher roll therein.

2. An electromagnetic pulse counting mechanism according to claim 1 wherein said indexing mechanism includes a series of indexing gears having an indexing gear shaft, a shift fork having a shift fork pivot shaft, said shift fork pivot shaft and said indexing gear shaft and said cypher roll shaft being of unequal lengths, said second side wall being provided with blind bores extending in different planes to receive the axle ends and comprising a part of said journal means.

3. An electromagnetic pulse counting mechanism according to claim 1 including a threaded pin molded to the exterior of said rear wall.

4. An electromagnetic pulse counting mechanism according to claim 1, including at least one supporting rib on said rear wall interior for fixing the magnet coil on the receiving tube.

5. An electromagnetic pulse counting mechanism according to claim 1 including interlocking connections on said first and second housing parts comprising a tongue arranged on said second side wall at spaced longitudinal locations having outwardly directed notches and corresponding recesses defined on said bottom and said cover of said first housing part into which the corresponding tongues are interengaged.

6. An electromagnetic pulse counting mechanism according to claim 1 wherein said first side wall includes at least one receiving slot, said second side wall having at least one projection with a portion engageable in said notch to hold said parts together.

* * * * *